US006904156B1

(12) United States Patent
LeReverend

(10) Patent No.: US 6,904,156 B1
(45) Date of Patent: Jun. 7, 2005

(54) SYSTEM AND METHOD FOR REDUCING HEARING AID SQUEAL

(75) Inventor: Remi LeReverend, San Diego, CA (US)

(73) Assignee: Zarlink Semiconductor (U.S.) Inc., San Diego, CA (US)

( * ) Notice: Subject to any disclaimer, the term of this patent is extended or adjusted under 35 U.S.C. 154(b) by 337 days.

(21) Appl. No.: 09/921,641

(22) Filed: Aug. 3, 2001

(51) Int. Cl.[7] ..... H04R 25/00
(52) U.S. Cl. ..... 381/312; 381/314; 381/323
(58) Field of Search ..... 381/312, 314, 381/320, 321, 323, 94.5, 120; 361/79; 323/234; 330/207 P

(56) References Cited

U.S. PATENT DOCUMENTS 3,769,919 A * 11/1973 Johnson ..... 361/79
3,924,159 A * 12/1975 Hoover ..... 361/101
5,131,046 A * 7/1992 Killion et al. ..... 381/320
6,320,969 B1 * 11/2001 Killion ..... 381/323

* cited by examiner

*Primary Examiner*—Huyen D. Le
(74) *Attorney, Agent, or Firm*—Knobbe Martens Olson & Bear LLP

(57) ABSTRACT

Squeal in a hearing aid is inhibited by a circuit that monitors battery voltage. In response to sensed low battery voltage, a cutoff circuit disables the hearing aid audio amplifier. Also in response to low battery voltage, a crowbar circuit loads the hearing aid battery with a loading circuit element.

11 Claims, 5 Drawing Sheets

SYSTEM AND METHOD FOR REDUCING HEARING AID SQUEAL

BACKGROUND OF THE INVENTION

1. Field of the Invention

The present invention relates to hearing aid amplifiers.

2. Description of Related Art

A hearing aid is typically comprised of a microphone which receives an acoustic input signal and converts it into an electrical signal, a filter which processes the signal, an amplifier which produces an amplified output signal, and a speaker which delivers the output signal.

With many hearing aid designs, especially those including Class D amplifiers, the amplifier will lose gain control under low battery conditions which may produce a loud squeal or gun shot noise. This may occur as the battery charge depletes with use, and also when a loud tone enters the hearing aid at a low frequency, causing the battery voltage to momentarily drop. Some hearing aids have been equipped with a latch which disables the hearing aid output when the amplifier oscillator frequency reaches a certain level. These prior art latches have not been completely effective, as latch activation can erroneously disable the hearing aid during a power supply transient in addition to a true low battery condition.

SUMMARY OF THE INVENTION

In one embodiment, the invention includes a circuit for reducing squeal comprising a battery supplying a battery output voltage, a voltage sensor having an output dependent on said battery output voltage, an audio amplifier, a cutoff circuit connected to substantially disable the audio amplifier in response to the voltage sensor output, and a crowbar circuit connected to load the battery in response to the voltage sensor output.

In another embodiment, the invention includes a hearing aid comprising an audio amplifier having an audio input, a power supply input, and an amplification input, and having an output. The hearing aid further comprises a microphone connected to the audio input of the audio amplifier, a speaker connected to the output of the audio amplifier, a battery having an output voltage, a voltage sensor having an input receiving the modified voltage and having a cutoff output, and a crowbar output, wherein the voltage sensor determines if the battery output voltage is below a threshold voltage. The hearing aid further comprises a cutoff circuit having an input connected to the cutoff output, and having an amplification output connected to the amplification input of the audio amplifier, such that in response to the cutoff output indicating the battery output voltage is below the threshold voltage the amplification output substantially disables the audio amplifier and a crowbar circuit having an input connected to the crowbar output, and connected to load the battery with a circuit element in response to the crowbar output indicating the battery output voltage is below the threshold voltage.

DETAILED DESCRIPTION OF THE PREFERRED EMBODIMENT

Embodiments of the invention will now be described with reference to the accompanying Figures, wherein like numerals refer to like elements throughout. The terminology used in the description presented herein is not intended to be interpreted in any limited or restrictive manner, simply because it is being utilized in conjunction with a detailed description of certain specific embodiments of the invention. Furthermore, embodiments of the invention may include several novel features, no single one of which is solely responsible for its desirable attributes or which is essential to practicing the inventions herein described.

Figure 1:
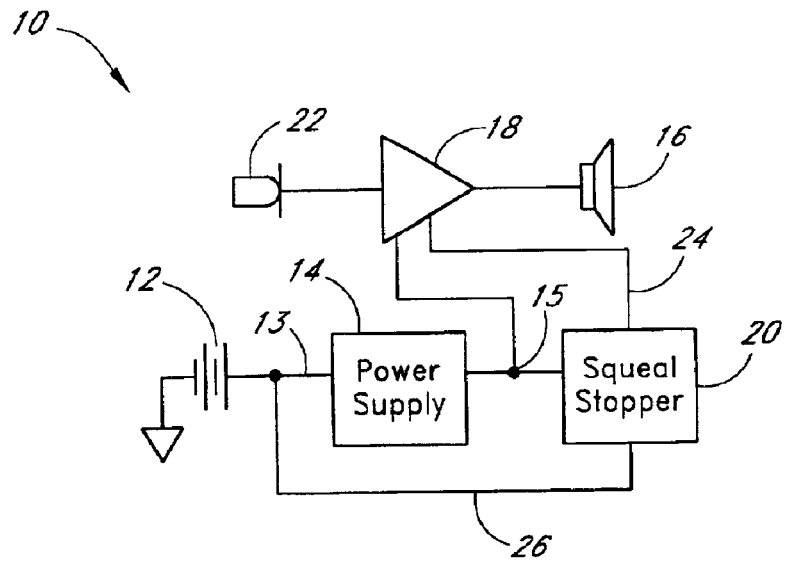
FIG. 1 is a block diagram of the components within a hearing aid, including a squeal stopper circuit.

FIG. 1 is a block diagram of the components within a hearing aid, including a squeal stopper circuit 20. Microphone 22 receives audible sounds and converts the sounds to electrical signals which are transmitted to audio amplifier 18. Audio amplifier 18 increases the strength of the electrical signals received from microphone 22 and sends the amplified signals to speaker 16. Speaker 16 converts the electrical signals to audible sounds which the hearing aid user may hear. Battery 12, which may be any suitable hearing aid battery, is coupled to a power supply 14. A typical hearing aid battery 12 may produce an output voltage at node 13 of about 1.4 volts with ESR of approximately 22 ohms when new, and may drop to less than 1.0 volt during its useful life of approximately one month (depending on the battery quality and hearing aid power requirements). Power supply 14 typically includes a charge pump which provides a voltage 15, which is a multiple of the battery 12 voltage, to the squeal stopper circuit 20. In one embodiment, power supply 14 provides a voltage that is three to four times larger than the battery 12 voltage, however, it is contemplated that different multiples of the battery 12 voltage may be provided by power supply 14. It will also be appreciated that in some embodiments the power supply 14 may be omitted entirely.

The squeal stopper circuit 20 is coupled directly to the battery output at node 13, and has an output 24 coupled to the audio amplifier 18. The squeal stopper circuit 20 reduces squeal generally caused by a low battery in two ways. First, when the battery voltage, and thus the power supply voltage, drops to a first threshold level the output 24 to audio amplifier 18 changes state. In response, the audio amplifier 18 is disabled, thus preventing any signal from reaching the speaker 16, and preventing squeal. In addition, when the battery voltage drops to a second threshold level, the squeal stopper circuit loads the battery with, for example, a current source or resistive element. This load prevents a bad battery from momentarily recovering voltage and causing the hearing aid to turn back on, potentially causing a squeal. However, a good battery will be relatively unaffected by the additional load and may continue to provide power to the hearing aid for its remaining useful life.

Due to size considerations, the audio amplifier, power supply, and squeal stopper circuitry will normally be fabricated as part of a common integrated circuit, although separate circuits may be used. The input and output transducers and battery are typically separate electromechanical components that attach to the integrated circuit via contact pads and/or wires.

Figure 2:
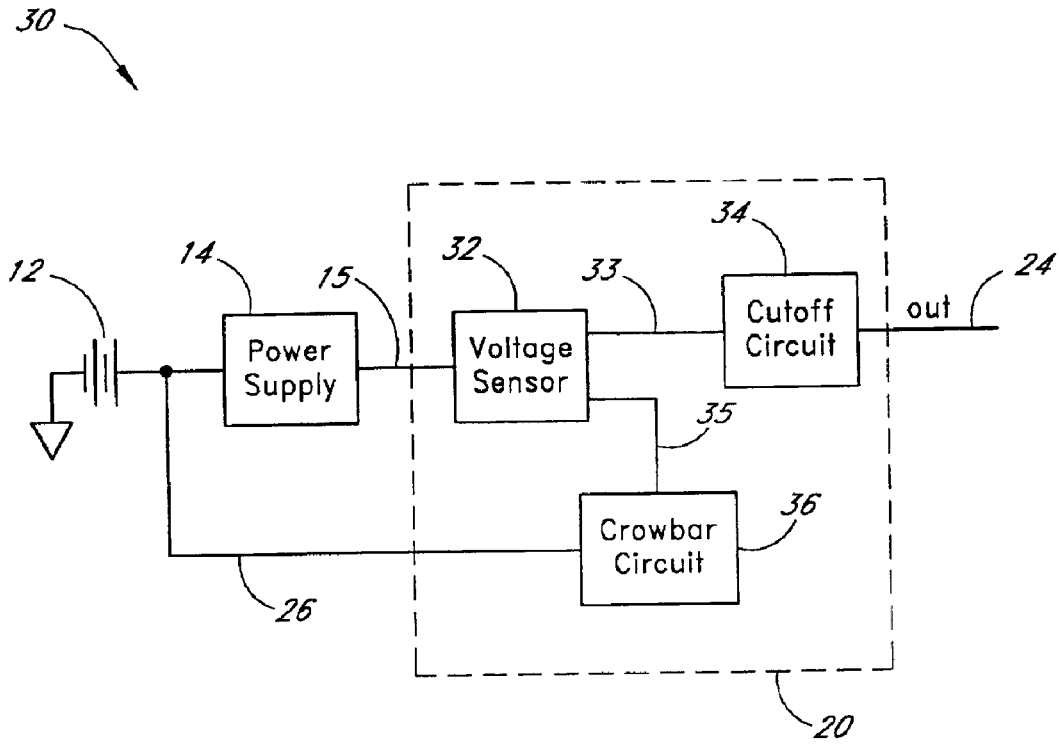
FIG. 2 is a high level block diagram of the components within the squeal stopper circuit of FIG. 1.

FIG. 2 is a block diagram of the components within the squeal stopper circuit 20 of FIG. 1. In one embodiment, the squeal stopper circuit 20 comprises three functional components: a voltage sensor 32, a cutoff circuit 34, and a crowbar circuit 36. Voltage sensor 32 determines if the battery 12 voltage has dropped below one or more threshold levels. In one embodiment, voltage sensor 32 includes a cutoff output 33 coupled to a cutoff circuit 34 that changes state when a first battery threshold level of 0.8 volts is reached. In addition, a crowbar output 35 which is couple to a crowbar circuit 36 changes state when a second battery threshold level of 0.75 volts is reached.

As shown in FIG. 2, in this embodiment the voltage sensor 32 receives an input from power supply 14, which provides an amplification of battery 12 voltage. As such, in the embodiment of FIG. 2, the voltage sensor determines when the battery 12 voltage has dropped below the determined battery threshold voltages (e.g. 0.8 and 0.75 volts) by monitoring the power supply 14 voltage. For example, in an embodiment where the power supply voltage 15 is four times the battery 12 voltage, the voltage sensor circuit 32 may determine that the battery 12 voltage is at the 0.8 volt first threshold when the power supply voltage is at 3.2 volts (i.e. 4×0.8 volts=3.2 volts). In another embodiment, the first and second threshold levels are reached when the power supply voltage is at 3.0 and 2.75 volts, respectively. It is contemplated that other threshold levels may be set according to the specific hearing aid characteristics, battery magnitude and quality, and other factors specific to the hearing aid.

Figure 4A:
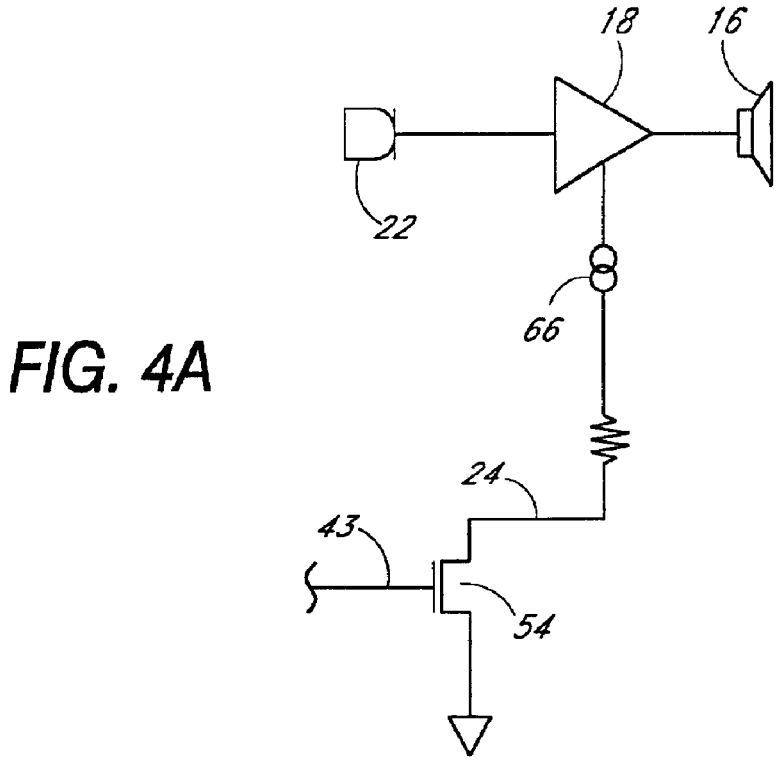
FIG. 4A is a schematic showing a first embodiment of a squeal stopper output coupled to a hearing aid.
Figure 4B:
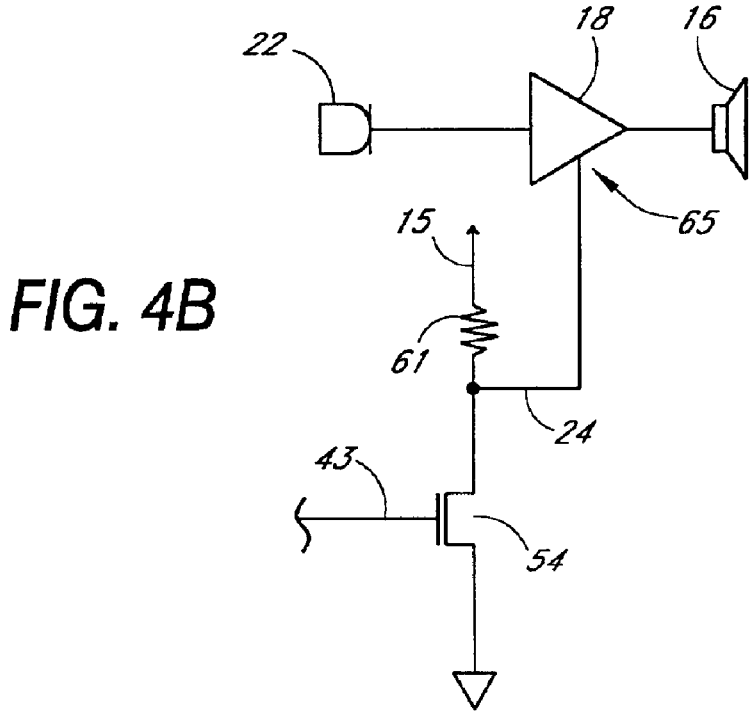
FIG. 4B is a schematic showing a second embodiment of a squeal stopper output coupled to a hearing aid.

Cutoff circuit 34 has an input coupled to the voltage sensor 32 and an output 24 coupled to the audio amplifier 18. When the cutoff input 33 indicates that the battery 12 voltage has dropped below a first threshold voltage (0.8 volts in one embodiment) the output 24 of the cutoff circuit 34 changes state. This state change disables the amplifier 18. The cutoff circuit may include simply a transistor or as a controlled current source. Depending on amplifier design, the cutoff output 24 may interact with the amplifier in different ways. In one embodiment, a transconductance preamplifier is disabled by opening the bias current path. In another embodiment, a "digitally controlled" amplifier is disabled by the output 24 changing state from a non-asserted to an asserted state. These embodiments are illustrated in FIGS. 4A and 4B.

Crowbar circuit 36 has an input coupled to voltage sensor 32 and an output coupled to the battery 12. As indicated above, the crowbar signal 35 indicates whether the battery 12 has dropped below a second threshold level (0.75 volts in one embodiment). When crowbar circuit 36 senses an input 35 indicating that the battery 12 has dropped below the threshold level, the crowbar output 26 loads the battery with a current source or a resistive element. In one embodiment, a resistor in the 1–10 kohm range has been found suitable for use in the crowbar circuit 36 to load the battery 12. In an advantageous embodiment of the invention, the battery loading circuit element is a 2000 ohm resistive element. If a current source is used, it may be configured to draw about 500 microamps from the battery to provide the desired loading. As mentioned above, this load prevents a bad battery from momentarily recovering and potentially causing a squeal on the hearing aid speaker 16.

It will be appreciated by those in the art that all voltages and resistor values discussed herein are examples only. It is contemplated that any battery voltage may be implemented in the present invention. In addition, the first and second threshold levels may be set to any value, and the threshold levels may be in reference to the battery voltage, the power supply voltage, or any combination of the two.

Figure 3A:
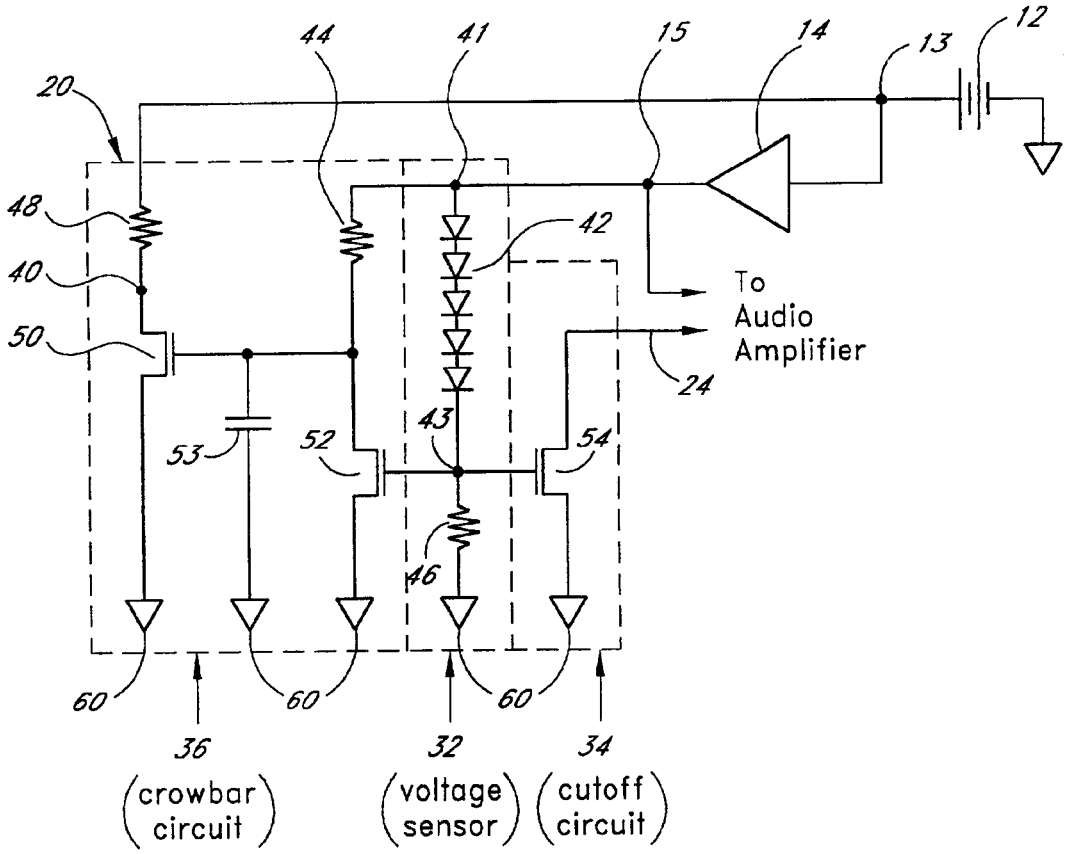
FIG. 3A is a schematic of a squeal stopper circuit in one embodiment of the invention.

FIG. 3A is an electrical schematic showing one embodiment of a squeal stopper circuit. The squeal stopper circuit 20 provides an output 24 to the audio amplifier 18 (not shown in FIG. 3) and receives as inputs the voltage of battery 12 (at node 13), and the power supply voltage 15. Audio amplifier 18 is enabled and disabled according to the state of output line 24. As shown in FIG. 3, the power supply 14 is coupled to battery 12 at node 13, As such, the power supply 14 receives the battery voltage and amplifies the battery output voltage by a predetermined multiplier. The power supply output at node 15 is coupled to a diode bank 42 and resistor 44 at node 41. Diode bank 42 is comprised of one or more series diodes to obtain a desired voltage drop. Five diodes are shown but more or fewer diodes may be employed depending on the application.

When a fresh battery 12 is in the hearing aid (e.g. a battery with voltage above both the first and second threshold levels), the audio amplifier 18 is operating at a determined amplification level, and the squeal stopper circuit draws only a small amount of current from the battery. With a fresh battery, the voltage at node 43 is still high enough after the drop across the diode bank 42 to force cutoff transistor 54 and inverting transistor 52 to the on state. When inverting transistor 52 is in the on state, crowbar transistor 50 is turned off because the on state of inverting transistor 52 ties the gate of crowbar transistor 50 to ground 60. In this state of normal, fresh battery operation, the crowbar circuit is open such that the battery is not affected, and the state of the output line 24 is grounded through cutoff transistor 54. It may be desirable, but not necessary, to include a filter capacitor 53 on the gate of crowbar transistor 50.

During normal operation, current is drawn from the power supply to ground through two pathways. One is through the diode bank 42 and resistor 46. The other is through resistor 44 and inverting transistor 52. In advantageous embodiments of the invention, resistors 44 and 46 are each at least about 100 megohms, thus limiting the total current draw from a 5 V power supply to no more than about 100 nanio-amps. In one suitable embodiment, approximately 200 megohm resistors are used for both resistors, whereby with a 5 V power supply output, each resistor draws about 25 nanoamps from the power supply. In another embodiment, resistor 44 is about 200 megohms, and resistor 46 is about 100 megohms. In these embodiments, therefore, during normal operation of the hearing aid when the power supply voltage 15 is about 2.5–5 volts, the squeal stopper circuit 20 draws a total of less than about 50–75 nanoamps from the battery 12, making it substantially transparent to the remainder of the circuit, and not causing a significant reduction in battery life.

When the battery 12 voltage decreases over time to a first threshold level (e.g. about 0.8 volts), the cutoff transistor 54 begins to turn off as its gate receives a decreased voltage through diode bank 42. At the same time, inverting transistor 52 begins to turn off. As the battery voltage reaches a second threshold level (e.g. about 0.75 volts), the increase in voltage on the gate of crowbar transistor 50 due to the increase in impedance of inverting transistor 52 turns on the crowbar transistor 50. When the crowbar transistor 50 is fully on, the battery is shunted to ground through resistor 48, which as discussed above, may be about 1000–10,000 ohms, with 2000 ohms having been found suitable in one embodiment.

In addition to a resistor 48, other battery loading circuit elements are possible to be used in place of the resistive element shown in FIG. 3A, such as a current source. In one embodiment, the crowbar circuit stresses the battery 12 by drawing approximately 500 microamperes. By loading the battery with the resistor 48, the crowbar circuit 36 causes the voltage of a weak battery to drop even further, and thus will advantageously prevent a weak battery from momentarily recovering. However, if a fresh battery is installed, and the battery voltage drop is due solely to a particular audio input signal, the additional load provided by the crowbar circuit will have no substantial effect. With this design, an old battery is prevented from repeatedly dropping and recovering in response to audio inputs with the associated risk of repeated squealing or gunshot noise. Instead, an old and weak battery will be loaded by the crowbar circuit such that recovery is impossible, and will remain loaded until the battery is replaced with a battery that is strong enough to raise the potential at node 43 of FIG. 3A enough to turn on the inverting and cutoff transistors, and thus to turn off the crowbar transistor 52. It can be seen that if the battery voltage drops below the threshold of transistors 52, 54, then no current will flow either.

In the embodiment of FIG. 3A, the threshold levels are determined mainly by the characteristics of the diode bank 42, the resistors 44 and 46, and the transistors 52 and 54. When implemented on an integrated circuit, the diode type (which is PIN type in one suitable embodiment) as well as the areas, lengths, etc. of these components can be designed to provide a desired relationship between the battery output voltage and the voltages on the gates of the cutoff, inverting, and crowbar transistors. The resistors may, for example, be fabricated from high resistance polysilicon regions of the integrated circuit. The diode characteristics are particularly significant, and may be modified within standard fabrication techniques to produce the desired voltage drops between the power supply output 15 and node 43. Response characteristics for the crowbar portion of the circuit will also be affected by the dimensions of the inverting transistor and crowbar transistor. The dimensions of the cutoff transistor 54 are advantageously selected to produce a low source-drain on state resistance. In one embodiment, the circuitry of squeal stopper 20 may be implemented on a 200 micrometer by 300 micrometer area of a semiconductor chip.

Figure 3B:
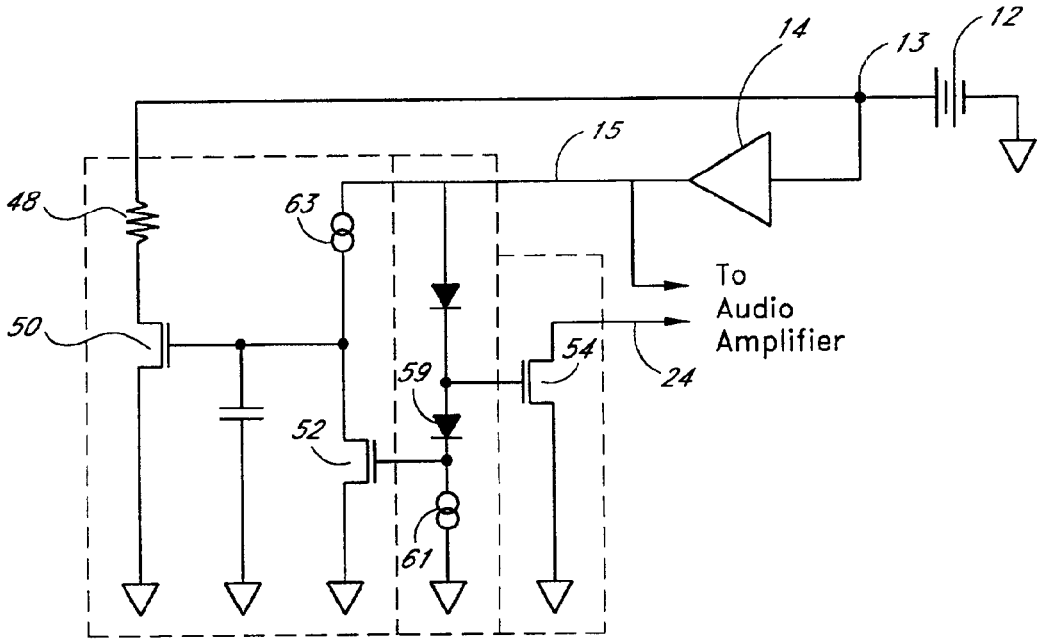
FIG. 3B is a schematic of a second embodiment of a squeal stopper circuit.

FIG. 3B illustrates a second embodiment of a squeal stopper circuit. This embodiment shares many characteristics with the embodiment of FIG. 3A, but in this case, the gate of the cutoff transistor 54 is held at a slightly higher voltage than the gate of the inverting transistor 52 by the diode drop from diode.59. This provides further time separation between the on state of the crowbar transistor 50 and the off state of the cutoff transistor as the battery voltage drops. In addition, in the embodiment of FIG. 3B, current draw in normal operation is controlled by 25–50 nanoamnp current sources 61, 63, rather than by simple resistive elements. As mentioned above, cutoff circuit element 54 may be embodied as a current source.

FIG. 4A is a schematic illustrating one embodiment of a squeal stopper output 24 coupled to an audio amplifier 18. In the embodiment of FIG. 4A, cutoff output 24 provides the ground path for the bias current of a transconductance amplifier. In this embodiment, the gain of audio amplifier 18 is controlled by a bias current to ground through current source 66. As the impedance of the cutoff transistor 54 increases, reducing the gain of the audio amplifier 18 to essentially zero when the cutoff transistor 54 is completely off.

FIG. 4B is a schematic illustrating a second embodiment of a squeal stopper output 24 coupled to an audio amplifier 18. In the embodiment of FIG. 4B, the audio amplifier has a digital enable input 65 that enables amplifier operation when low, and disables amplifier operation when high. The cutoff line 24 is tied to the power supply output 15 through a pull-up resistor 61. During normal fresh battery operation, cutoff transistor is open, and ties the cutoff line 24 to ground. As cutoff transistor 54 becomes closed due to decreasing power supply voltage 15, the cutoff line is pulled high to the power supply output through resistor 61.

Figure 5:
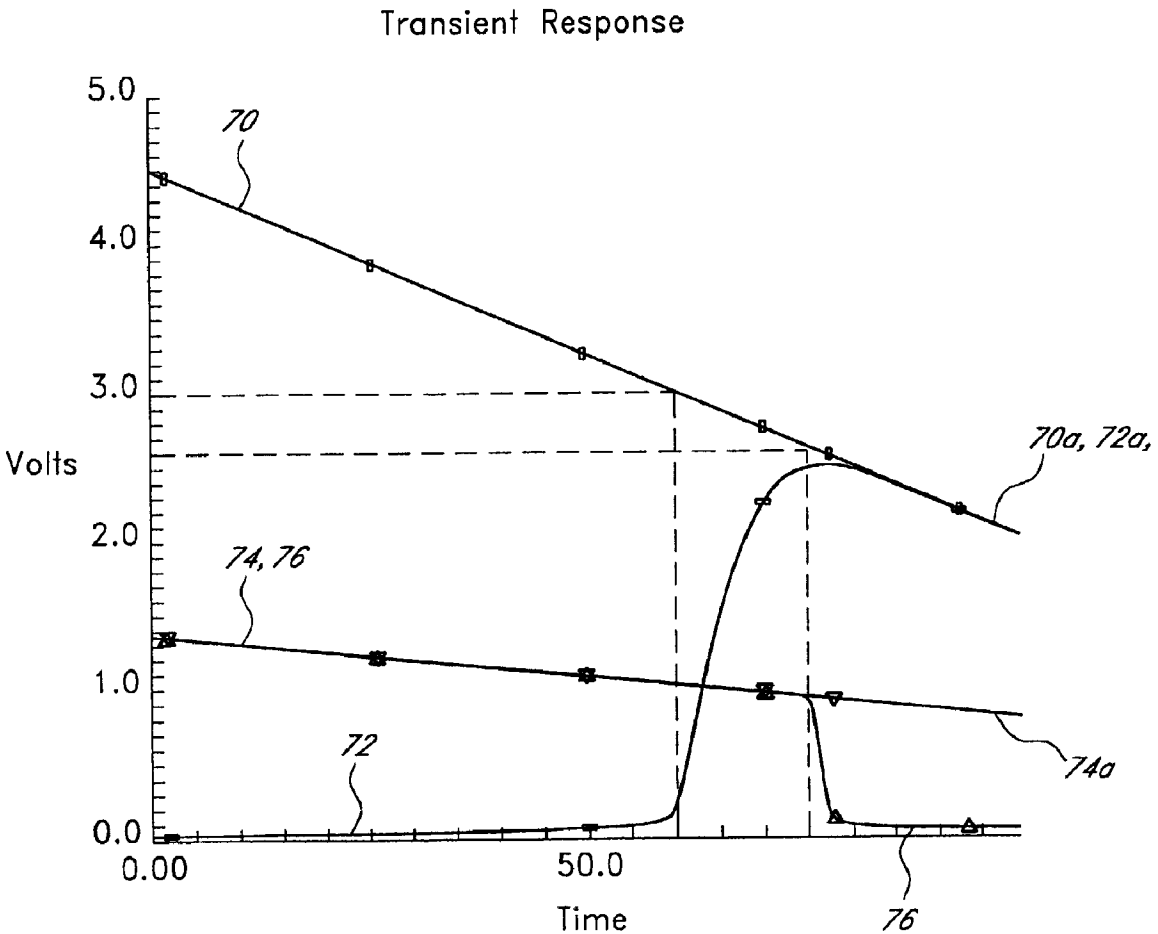
FIG. 5 is a graph illustrating operational characteristics of the squeal stopper circuit of FIG. 3A.

FIG. 5 is a graph showing the voltage levels at various nodes of the circuit of FIG. 3A, over a period of time as the battery voltage drops. The graph illustrates for the sake of demonstration the behavior of the circuit when node 15 and node 24 are resistively coupled. The vertical axis of FIG. 5 is in units of volts, while the horizontal axis is in time units. This graph illustrates a rapid drop in battery voltage over the course of about 100 milliseconds, which may be due, for example, to attempting to amplify a high amplitude, low frequency input signal. It will be appreciated, however, that the time scale of voltage drop may be different, and at least portions of the voltage drop can occur slowly over days or weeks of battery use. In addition, while the voltages shown in FIG. 5 approximate actual voltages used in some embodiments of the invention, they are intended only to serve as exemplars of the operation of the present invention, and not to limit the invention to the specified voltages and/or time scales.

Turning back to both FIGS. 3 and 5, curve 70 shows the voltage at node 15, which is the output voltage generated by the power supply 14. Curve 72 shows the voltage at node 24, which is the voltage level on the cutoff line. Curve 74 shows the voltage at node 13, which is the battery output voltage. Finally, curve 76 shows the voltage at node 40, which is the voltage on the grounded side of crowbar resistor 48.

As seen in FIG. 5, at t=0 node 13 is at approximately 1.35 volts, node 15 is approximately 4.5 volts, and node 24 is approximately 0 volts (since it is tied to ground through closed cutoff resistor 54). Node 15 is a multiple of node 13, through the operation of power supply 14, and, thus, the voltages at the two nodes change proportionally. When node 15 approaches approximately 3 volts, the cutoff transistor 54 begins to open, and the voltage at node 24 (or output signal 24) begins to increase. As the power supply voltage 15 continues to decline, transistor 54 continues opening until it is completely open, causing output signal 24 to have a voltage substantially equal to power supply voltage 15. Nodes 24 and 15 then decrease simultaneously.

Shortly after cutoff transistor 54 begins to approach a completely off high impedance state when power supply 15 voltage reaches approximately 2.6 volts, crowbar transistor 50 begins going to low impedance due to the operation of inverter transistor 52. Node 40 then begins to decrease in voltage as crowbar transistor 50 continues closing and grounding this node. The voltage at node 40 continues to decrease, as transistor 50 continues to close, until the voltage at node 40 reaches approximately zero volts.

Once the crowbar transistor 50 is fully on, the behavior of the system will depend on whether the battery is old and weak or fresh. If the battery is fresh, the load from crowbar resistor 48 will not prevent the battery voltage from recovering and going back up after a transient load.

On the other hand, with a weak battery, the voltage at node 13 will continue to drop due to the additional crowbar resistor load as illustrated by curve 74*a*. This will also reduce the power supply output voltage curve 70 at node 15. It can be recognized that eventually curve 70 meets curve 74 and eventually transistor 50 shuts off beyond the useful range of interest.

The foregoing description details certain embodiments of the invention. It will be appreciated, however, that no matter how detailed the foregoing appears in text, the invention can be practiced in many ways. As is also stated above, it should be noted that the use of particular terminology when describing certain features or aspects of the invention should not be taken to imply that the terminology is being re-defined herein to be restricted to including any specific characteristics of the features or aspects of the invention with which that terminology is associated. The scope of the invention should therefore be construed in accordance with the appended claims and any equivalents thereof.

What is claimed is:

1. A circuit for reducing squeal comprising:

a battery supplying a battery output voltage;

a voltage sensor having an output dependent on said battery output voltage;

an audio amplifier;

a cutoff circuit connected to substantially disable said audio amplifier in response to said voltage sensor output; and a crowbar circuit connected to load said battery with a circuit element in response to said voltage sensor output.

2. The circuit of claim 1, further comprising:

a power supply having an input coupled to said battery, wherein said power supply creates a modified voltage;

wherein said voltage sensor determines if said battery voltage is below a threshold voltage by monitoring said modified voltage.

3. The circuit of claim 2, wherein said voltage sensor draws less than about 100 nanoamps of current from said power supply.

4. The circuit of claim 1, wherein said voltage sensor comprises a voltage divider.

5. The circuit of claim 4, wherein said voltage divider comprises a resistor in series with at least one diode.

6. The circuit of claim 5, wherein said cutoff circuit and said crowbar circuit each comprise a transistor with a gate connected to the circuit node connecting said resistor and at least one diode.

7. A hearing aid comprising:

an audio amplifier having an input and an output;

a microphone connected to said input of said audio amplifier;

a speaker connected to said output of said audio amplifier;

a battery having an output voltage;

a cutoff circuit responsive to said battery output voltage and configured to substantially disable said audio amplifier in response to low battery output voltage; and a crowbar circuit responsive to said battery output voltage and configured to load said battery with a loading circuit element in response to low battery output voltage.

8. The hearing aid of claim 7, wherein said loading circuit element comprises a current source.

9. The hearing aid of claim 8, wherein said current source is configured to draw approximately 500 microamperes from said battery.

10. The hearing aid of claim 7, wherein said loading circuit element comprises a resistor.

11. The hearing aid of claim 10, wherein said resistor has a resistance of about 1000 to 10,000 ohms.

* * * * *